US007267509B1

(12) United States Patent
Jackson, III

(10) Patent No.: US 7,267,509 B1
(45) Date of Patent: Sep. 11, 2007

(54) FLOATATION DEVICE

(76) Inventor: William H. Jackson, III, P.O. Box 10940, Wilmington, NC (US) 28404

( * ) Notice: Subject to any disclaimer, the term of this patent is extended or adjusted under 35 U.S.C. 154(b) by 0 days.

(21) Appl. No.: 11/414,464

(22) Filed: May 1, 2006

(51) Int. Cl.
*B63C 9/13* (2006.01)

(52) U.S. Cl. ..... 405/186; 441/88; 441/122

(58) Field of Classification Search ..... 405/186; 441/88, 90–107, 122
See application file for complete search history.

(56) References Cited

U.S. PATENT DOCUMENTS

| | | | | | |
|---|---|---|---|---|---|
| 2,165,300 | A | | 7/1939 | Peterson | 9/19 |
| 3,130,424 | A | | 4/1964 | Santangelo | 9/316 |
| 3,302,224 | A | | 2/1967 | Boucher | 9/316 |
| 3,907,236 | A | * | 9/1975 | Sims, Jr. | 242/404.1 |
| 3,935,608 | A | | 2/1976 | Freedman et al. | 9/319 |
| 4,626,221 | A | | 12/1986 | Rocco | 441/108 |
| 4,629,436 | A | * | 12/1986 | Stewart et al. | 441/93 |
| 4,887,987 | A | * | 12/1989 | Kato | 441/96 |
| 5,178,569 | A | | 1/1993 | Wang | 441/93 |
| 5,374,212 | A | * | 12/1994 | Lall | 441/96 |
| 5,393,254 | A | | 2/1995 | Duecheshe | 441/118 |
| 5,456,623 | A | | 10/1995 | Norris | 441/92 |
| 5,466,179 | A | | 11/1995 | Jeffrey, Sr. | 441/108 |
| 5,823,840 | A | * | 10/1998 | Powers | 441/122 |
| 6,036,562 | A | | 3/2000 | Brown | 441/108 |
| 6,106,348 | A | | 8/2000 | Loisel | 441/108 |
| 6,231,411 | B1 | | 5/2001 | Vinay | 441/120 |
| 6,394,866 | B1 | | 5/2002 | Brown | 441/108 |
| 6,551,159 | B1 | * | 4/2003 | Spinelli et al. | 441/80 |
| 6,805,599 | B1 | * | 10/2004 | Huang | 441/88 |
| 6,899,583 | B2 | * | 5/2005 | Barden | 441/89 |
| 2004/0033740 | A1 | * | 2/2004 | Jones | 441/122 |

* cited by examiner

*Primary Examiner*—Frederick L. Lagman
(74) *Attorney, Agent, or Firm*—Michael E. Mauney

(57) ABSTRACT

A wrist mounted inflatable floatation device to provide temporary floatation support for a swimmer, boater, wader, or other person who is in the water. A wrist mounted floatation device is conveniently worn when someone is in the water or on a boat. It is attached to the wrist by a wrist strap which is adjusted for a snug fit around wrists of a variety of sizes. Mounted on said wrist strap is a deflated and folded inflatable bladder. Also mounted on said wrist strap are means for inflating said inflatable bladder when need for a floatation device presents itself to a user. The means can be high-tech gas storage devices, such as carbon nanotubes or chemicals, that when triggered produce a chemical reaction to produce either a gas or a gas filled polymer material, or a simple inflation tube and check valve, which allows a user to manually inflate the bladder. The bladder is attached to the wrist strap by a cord. When inflated, the bladder detaches from the wrist but remains attached to the wrist by the cord. The bladder will ordinarily be made of some highly reflective material or be colored with a readily visible color such as yellow or orange. The bladder is sized to be large enough to provide floatation support for an ordinary person. It is not designed for use with a person who is unconscious or otherwise unable to grip and use the bladder to support themselves in water. Because of its convenient size and wrist mounting, it is more likely to be utilized than cumbersome life jackets or life vests.

1 Claim, 5 Drawing Sheets

FLOATATION DEVICE

FIELD OF THE INVENTION

This invention relates to an individual floatation device for use by a person that combines ease of use with versatility and simple construction.

BACKGROUND OF THE INVENTION

Life jackets or personal floatation devices are available in many shapes, materials, and designs. Passenger vessels are ordinarily required to carry a sufficient number of life jackets or personal floatation devices to equip each anticipated passenger in the boat. Recreational boaters also carry personal floatation devices with them. As a general rule, personal floatation devices fall into two separate designs.

One design consists of a vest-like design ordinarily made of some inherently buoyant material. Different types of hard or soft foam material, which are ordinarily a polymer material partially filled with gas pockets, which are inherently lighter than water, in part because of the gas pockets contained within the foam material. These devices will ordinarily be worn by someone who is either on, or expects the possibility of, being immersed in water. For example, these life jackets would ordinarily be worn kayakers or water skiers.

A second type of device consists of a more compact molded package in which a particular shape is made of gas impermeable bladder-like construction. Gas is then injected into the bladder-like construction using different expedients. They could be as simple as blowing it up, using a compressed gas cartridge, or using chemical reaction to produce gas, which will then fill the gas impermeable bladder. As a bladder fills with gas, the pressure of the gas is greater than the air outside so the bladder assumes a shape in response to the gas pressure which may resemble the shape of the permanent foam life jackets.

The second type of device will be frequently employed for people who do not anticipate being in the water or, if in the water, do not anticipate the need for any kind of floatation device. Therefore, it is desirable to have a small compact, perhaps concealed, device with them which would only be used in the event of the need of a floatation device.

BACKGROUND ART

One example of a portable, uninflated personal floatation device which may be inflated at need is seen in Peterson, U.S. Pat. No. 2,165,300. Here, a $CO_2$ cartridge is concealed within a safety life belt which appears like an ordinary belt. The gas cartridge is in the buckle of the belt. A rubber bladder is inflated by gas coming from the cartridge, which will then be held in place around the waist of the user by the belt itself. A second variation is seen in Santangelo, U.S. Pat. No. 3,130,424. Here, a concealed device inflates automatically when reaching a certain depth. It will inflate in such a fashion that it will automatically keep a wearer's head tip above water. Wang, U.S. Pat. No. 5,178,569 shows a deflated bladder with an automatic inflation cylinder. Ordinarily, it would be activated by the user. Its widest use would be anticipated for swimmers. Another variation is seen in Ducheshe, U.S. Pat. No. 5,393,254. This is designed to be use in conjunction with a fisherman's wader. It is well know that wading fisherman may step into a hole or otherwise find themselves in trouble in deep water. The Ducheshe device is an inflatable vest attached to a wader designed to inflate to provide a floatation device for a fisherman. Loisel, U.S. Pat. No. 6,106,348 discloses a belt mounted inflatable bladder. This uses not only a gas cartridge but also allows a user to blow it up. Vinay, U.S. Pat. No. 6,231,411 discloses a floatation device that can be worn with articles of clothing and concealed in the article of clothing. It is both manually and automatically inflatable.

Some of the above described devices are designed to hold an unconscious swimmer's head above water. These devices necessarily involve attachments to the body of a swimmer in a way that could be perceived as an user as unattractive, cumbersome, or uncomfortable. A device that is unattractive or uncomfortable is much less likely to be used than an attractive or convenient device. Many of these devices are designed to provide for hours or perhaps even days of floatation for their users. If a small boat is in the ocean and sinks, a person may be in the water for many hours before there is any rescue. Consequently, the demands of a floatation device which can keep an unconscious person's head above the water or which can hold someone above water for many hours necessarily introduces design parameters, which makes the resulting device bulky or unattractive for use by a casual swimmer. For these reasons, many of the above devices have been unpopular and unsuccessful in the market place.

SUMMARY OF THE INVENTION

Despite the extensive earlier work in this field, there is still an unmet need for a device to meet particular needs of swimmers, especially inexperienced or inexpert swimmers who may require a floatation device in the event of a cramp, an unexpected current in the water, a rip tide, or such similar event. To fill this unmet need, a device can be designed for use only by an individual who has need of it near shore. It would be for use by a swimmer who would ordinarily be no further from the shore than they can comfortably swim to and then return to the shore. Secondly, it should be designed for individuals who are conscious and who can both activate and use the device. Third, it should be designed to provide short term floatation aid. Ordinarily, if a swimmer is near the shore, there will be other swimmers around them, lifeguards, or people that can quickly provide help. In the event of a cramp, an undertow, or a rip tide, ordinarily a swimmer will be able to return to shore once the momentary condition which created the emergency is over. The design parameters required for this emergency circumstance may be different than a life jacket for a boat or airplane. These are designed to fit around a user and to keep their head out of water even if the user is unconscious or impaired. However, for the current invention, enough floatation must be provided to keep a user afloat, but it is understood that a user will have the ability to hold onto the device and to assist the device in keeping their head above water. There is no need to design the device so that it will last for hours and will attach around the body of an individual so that it will hold them afloat without any physical effort on the part of the user.

The current invention is designed to be worn unobtrusively around an individual's wrist in a convenient compact shape. This kind of design might be impractical if where the only gas source is a compressed gas cylinder, which has powered many of the earlier devices mentioned above. However, it is now possible, using chemical reactions, to produce a gas where only a very small amount of the gas producing source is required. Using modern materials, very thin gas impermeable membranes can be designed into a small cushion or ball-like shape, which can readily filled by gas or air. Such a small floatation device will require active participation by the person using it to hold it and to use it to hold his or her self above water. Over a long period of time, this would be tiring and might not be adequate. But for a person who expects to use it for perhaps no more than one hour, the floatation provided by a relatively small volume gas filled bag need not be very large. Consequently, it is an object of the current invention to be small, compact, and easily worn around the wrist of a user. It is an object of the current invention to not be built into a particular swimsuit or belt design, but can be transferred from the wrist of one user to another as needed. Third, it is an object of the current invention to be inexpensive to produce and easy to use without any special instructions or knowledge.

The invention will consist of a wrist strap or band, adjustable for different sizes of wrists. Although it is anticipated that perhaps one band could serve virtually all individuals, it could also be sold in small sizes for children or adolescents, medium sizes for larger adolescents and average size adults, and in large sizes for large people with big wrists. Contained within a package on the band will be a tightly folded, compact, inflatable bladder made of gas impermeable material. One such material that might serve is Mylar but there are other kinds of material that would also serve. Third, there will be means to fill the bladder with a gas or with air. One way of filling the bladder could consist of two chemicals, which mixed together will interact to produce either a gas or a gas filled polymer material, which will fill the impermeable bladder. For this embodiment, there will be a triggering device, which will initiate the chemical reaction to produce the floatation material, be it gas or a gas filled polymer. Only when the container holding the folded compact inflatable bladder is open will the chemical reaction be triggered so the inflatable bladder can be deployed as the chemical reaction fills the bladder with floatation material. An individual will wear the device on his wrist. It will be designed to be impermeable to water and to be durable. When necessary, the triggering device can be used to cause a reaction at the gas source to fill the bladder. These reactions happen very quickly and it would be a matter of no more than a second or two before the bladder is filled. It will be attached to the wrist device by a small durable cord so that it would not float away from the swimmer in need. The swimmer could then grab the bladder and use it to at least partially support himself until the triggering event, such as a cramp or an undertow, is no longer present, then the individual using the device could paddle back to the shore or await rescue by a lifeguard or other individuals.

Another way of filling the bladder allows the user to blow up the inflatable bladder using a valve stem and a check valve to hold the air inside the inflatable bladder. The use of this means of inflating the bladder does not exclude the means described above of using a chemical reaction to inflate the bladder. Indeed, it is anticipated that in most applications there will be the possibility of using both means, one as a back-up for the other. The user inflated bladder has the advantages of being simpler to design and less expensive to manufacture. It has a disadvantage of requiring a user to have enough presence of mind, in what be a difficult or emergency situation, to inflate the bladder. However, many emergency systems that use an inflatable bladder, such as an airplane, use a user inflation as a secondary means of inflating a swim bladder in the event the primary means does not function. Consequently, it is believed that it is practical for a user to inflate a bladder under most circumstances.

DETAILED DESCRIPTION OF THE DRAWINGS

Figure 1:
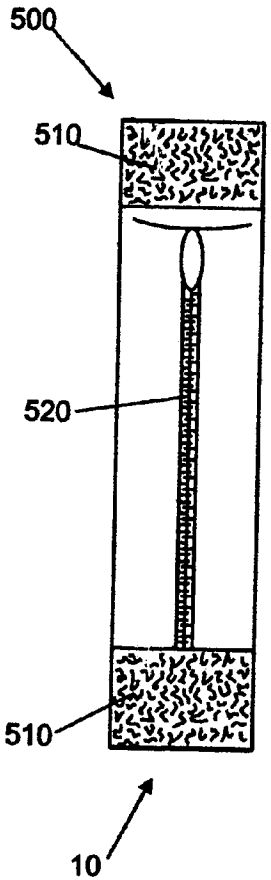
FIG. 1 and FIG. 1A shows one embodiment of the floatation device.
Figure 1A:
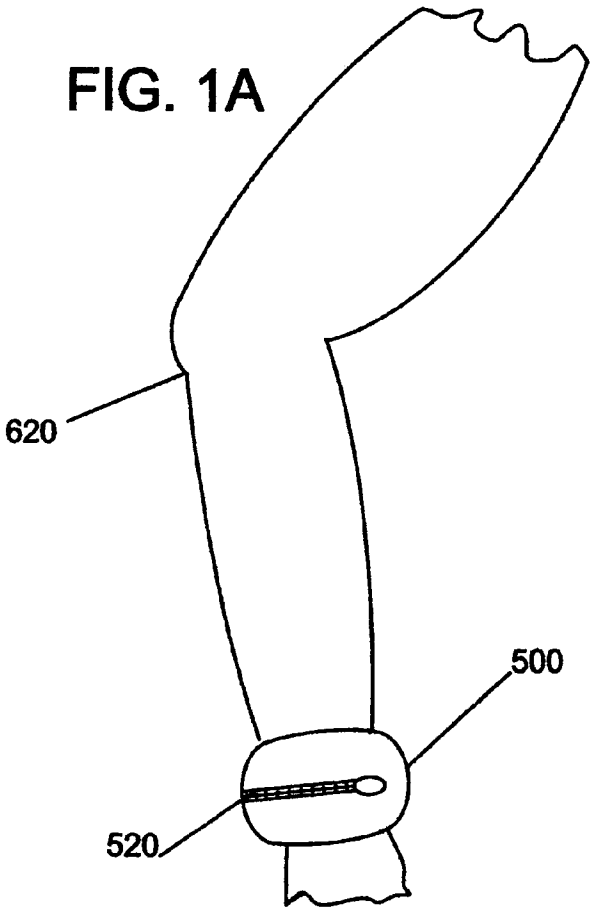

FIGS. 1 and 1A show an embodiment of the floatation device (10). It is basically a broad, flat envelope-like device (500). Disposed at opposite ends of the envelope-like floatation device (500) are matching mating hook-and-eye attachments (510). Disposed lengthwise on the envelope floatation device (500) is a zipper (520). FIG. 1A shows the envelope-like floatation device (500) wrapped around the arm of a user (620). The zipper (520) on the envelope-like floatation device (500) is zipped closed and the device is not in use.

Figure 3:
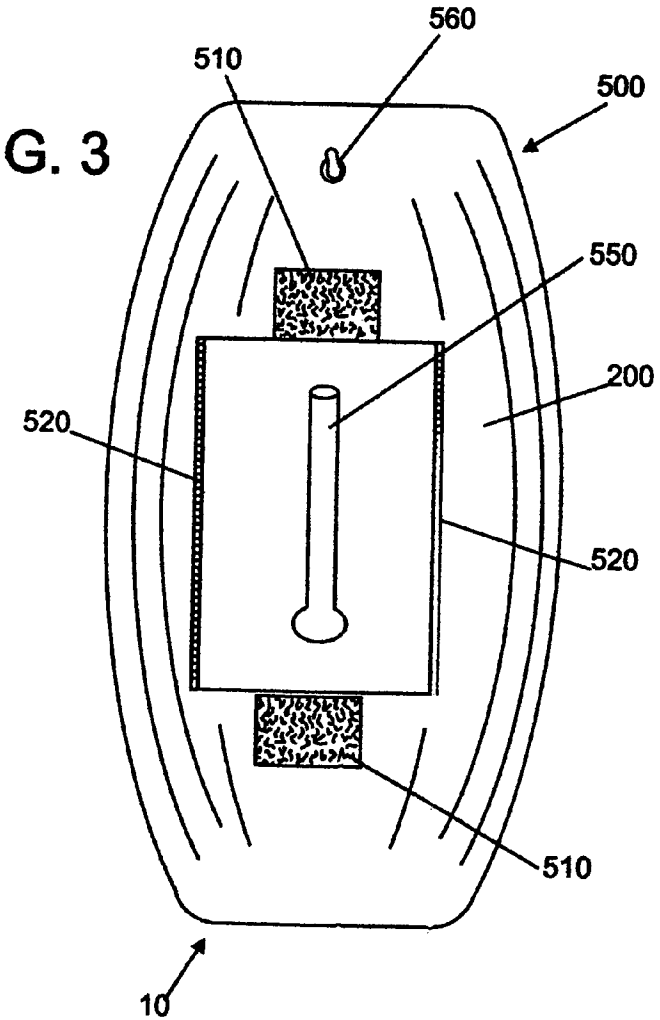
FIG. 3 shows the embodiment inflated.
Figure 2:
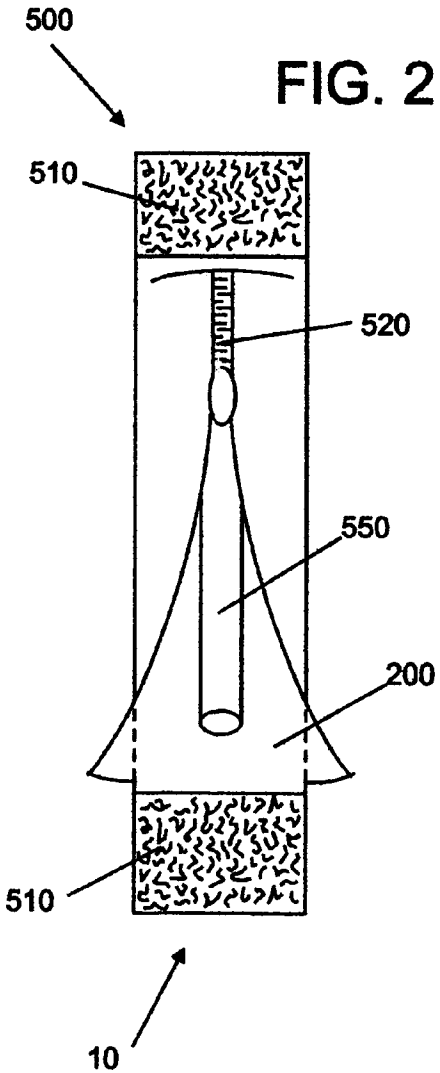
FIG. 2 shows the floatation device partially open.

FIG. 2 shows the device with the zipper (520) partially open. This reveals a small inflation tube (550), which is used for inflating the bladder (200) contained within the envelope-like floatation device (500). An otherwise not incapacitated user (600) (shown in FIG. 8) who is suddenly caught in a rip tide or unusual event can quickly unzip the zipper (520) and blow into the inflation tube (550) to inflate the bladder (200). The bladder (200) is shown more fully inflated in FIG. 3. As the bladder (200) blows up, it will unfold itself from the underside of the envelope-like floatation device (500) as it fully inflates. The hook-and-eye attachment means are at each end of the now unzipped zipper (520). The inflation tube (550) will ordinarily has a check valve (not shown) at its end, which will allow air to enter the bladder (200) but not to leave the bladder (200). The inflation tube (550) is shown in this view although it is actually positioned on top of the buoy and is shown here stylized in a position where it would not ordinarily appear. To deflate the bladder (200) will require use of the deflation valve (560) seen in FIG. 3. Ordinarily, there will be a small cord (210) attached to and made part of the envelope-like floatation device (500). It is not seen in FIG. 3 but it is seen in FIG. 8, which shows the device in use with a user (600) in the water using his arm (620) to hold on to the now inflated bladder (200).

Figure 4A:
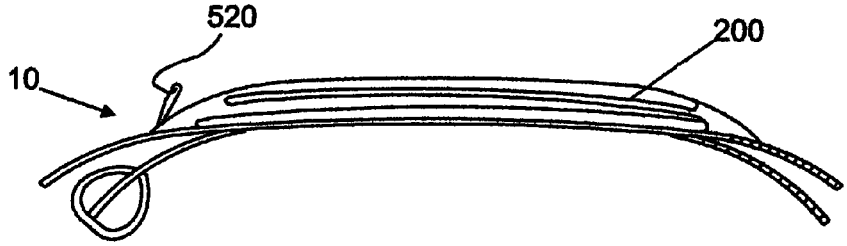
FIGS. 4A, 4B, and 4C shows different views of an alternative embodiment of the floatation device.
Figure 4B:
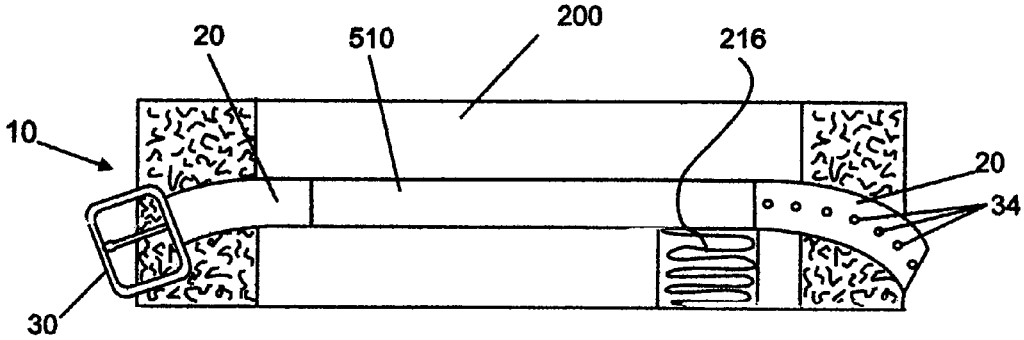
Figure 4C:
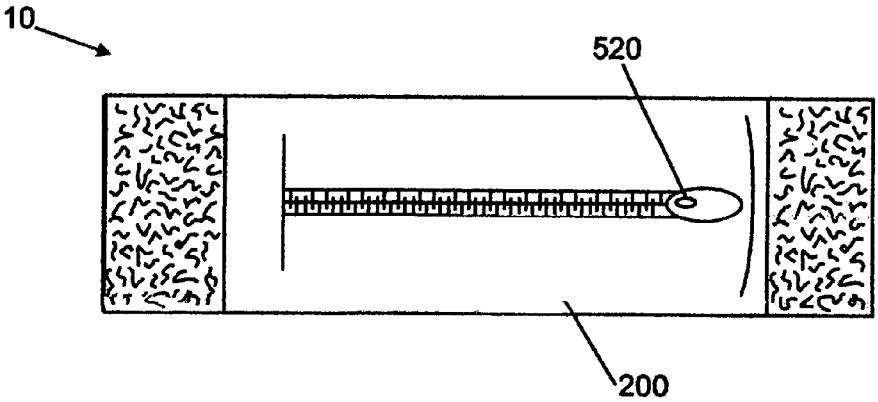

FIGS. 4A, 4B, and 4C show an alternative embodiment of the floatation device (10). FIG. 4A is a side view of the alternative floatation device. FIG. 4B is a bottom view and FIG. 4B is a top view. Here, the bladder (200) removably attaches to the wrist strap (20) by means of a hook-and-eye attachment means (510). Here, the entire unfolded floatation bladder (200) detaches from the wrist strap (20) but is securely connected to the wrist strap (20) by the cord (216), which is folded up in an appropriate compartment in the floatation bladder (200). If the floatation bladder (200) attached to the wrist only by means of a hook-and-eye attachment means like Velcro, as seen in FIGS. 1, 1A, and 2, there is concern that it could be easily dislodged in a panic situation. Here, the wrist strap (20) securely attaches by means of the buckle (30) and the buckle holes (35) on the wrist strap (20). The attachment cord (216) is securely attached to the wrist strap (20). Consequently, a user can tear away the floatation bladder (200) from the wrist strap (20) by the hook-and-eye attachment means (510), use a zipper (520) to zip open the top cover of the bladder (200), then use an inflation tube (516), which is seen more clearly in FIG. 5 to inflate the bladder (200).

Figure 5:
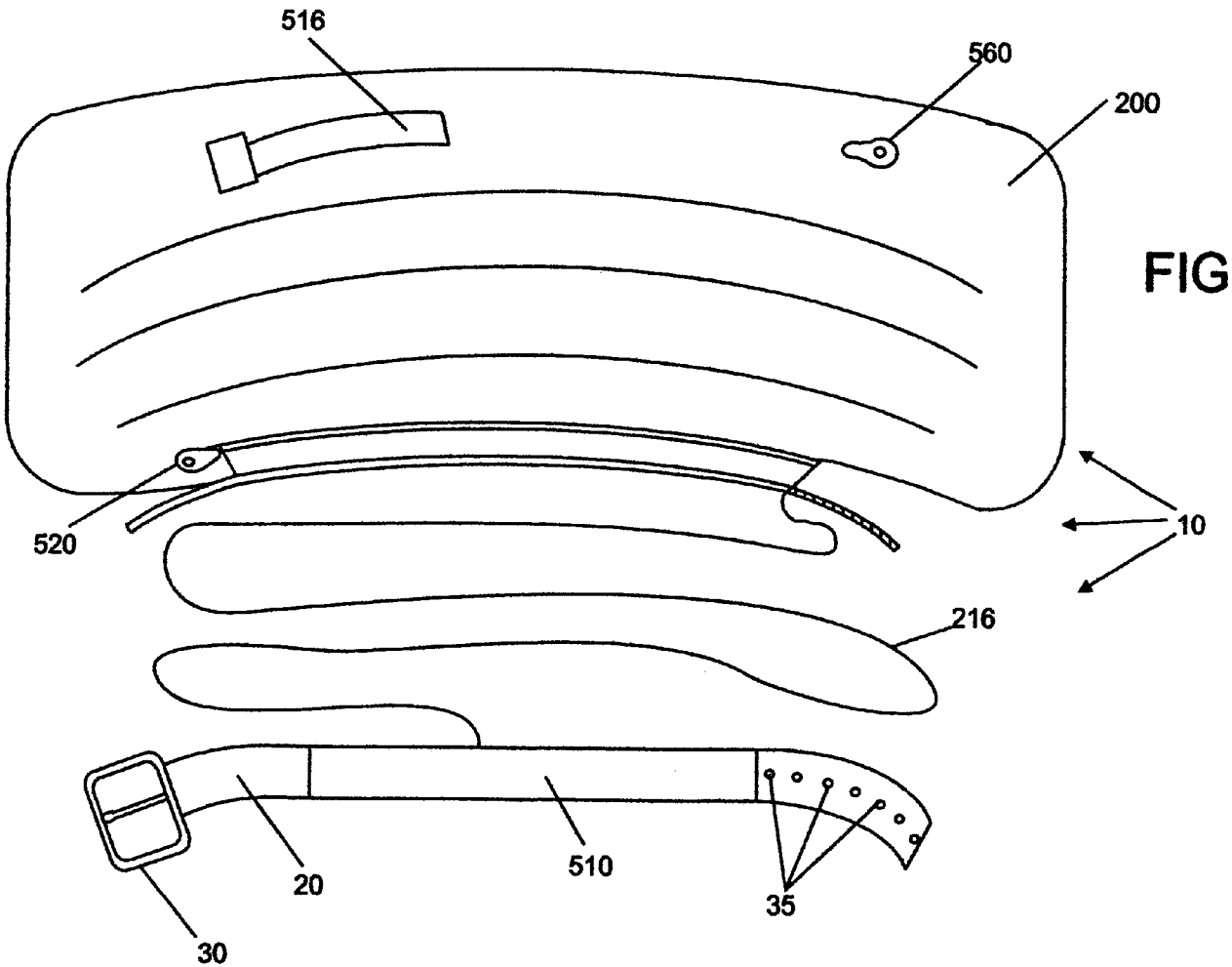
FIG. 5 shows the embodiment of FIGS. 4A, 4B and 4C inflated.

FIG. 5 shows the inflation bladder (200) after inflation by use of the inflation tube (516). There is a deflation valve (560), which would allow the device to be reused. The inflation bladder (200) has been torn away from the hook-and-eye attachment means (510) but is still attached to the wrist strap (20) by means of the cord (216). The zipper (520) has been retracted to allow the bladder (200) to fold out for inflation using the inflation tube (516). Unseen is a check valve at the base of the inflation tube (516), which will allow air to enter the inflation tube (516) but will not allow air to leave the inflation tube. It will be understood that a chemical means could be used as well as the inflation tube (516) to inflate the bladder (200). Either the inflation tube (516) could be used as a primary means of inflating the bladder (200), or the chemical means could be used as the primary means with the inflation tube (516) used as a back-up. There is no requirement that there be a single means for inflating the bladder (200). In the embodiment seen in FIGS. 4 and 5, the wrist strap (20) will remain securely attached to a user's wrist and the inflated bladder (200) will remain securely attached to the wrist strap (20), hence to a user by the cord (216).

Figure 6:
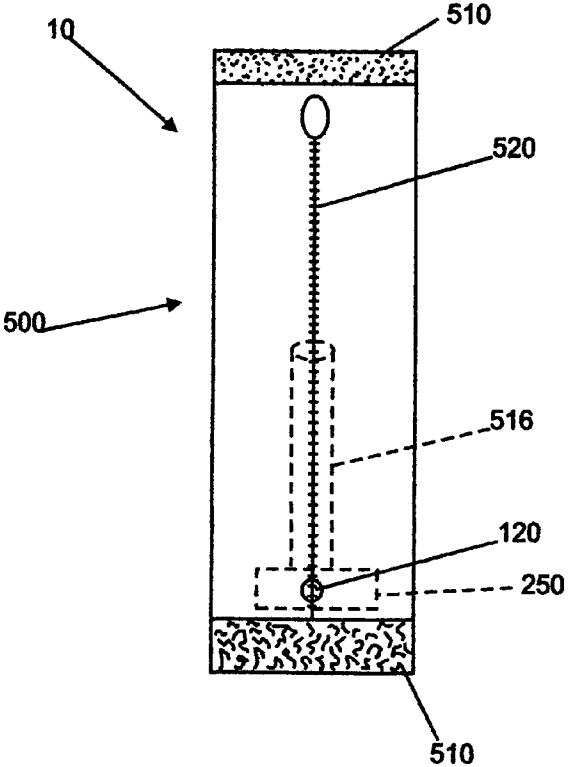
FIG. 6 shows an alternate embodiment of the floatation device.

FIG. 6 shows an embodiment of the wrist flotation device (10) with a alternate means of inflating the flotation device (10). Disposed at one end of the flotation device (10) are the hook and eye attachment means (510). At the opposite end are matching means (510) which in this view are concealed underneath the envelope-like flat flotation device (500). Again, there is an inflation bladder (200) (not seen) folded and contained within the broad flat envelope-like device (500) with a zipper opening (520). The inflation tube (516) is shown in dotted lines because it would ordinarily be beneath the surface of the broad flat envelope-like device (500). However, here, in addition to the inflation tube (516) there is a trigger (120) which is used to initiate the gas means (250) to fill the bladder (200) (not shown). A variety of technologies can be employed to fill the flotation bladder (200). Here a chemical pack could serve as a gas means (250). Among different chemical reactions that can be used produce a large amount of gas in a short period of time, there is a chemical called sodium azide, NaN3. Sodium azide begins to decompose at 300 degrees centigrade to produce sodium and nitrogen gas. An electrical impulse can create the 300 degrees centigrade necessary to initiate the decomposition reaction of sodium azide to produce nitrogen gas. Other chemicals are added, such as silicon oxide, to react with the sodium to reduce it to a harmless material since sodium is highly reactive and potentially explosive. It is also possible that carbon nanotubes may be used to store gas under pressure hence to serve as the gas means (250). The trigger (120) could fracture the nanotubes releasing the gas sufficient to fill the flotation bladder (200) (not shown). Here, it would be understood that, if for some reason, the gas means (250) did not produce gas sufficient to fill the bladder (200), then the manual inflation tube (516) could be used as an alternative method. It will be understood that the flotation bladder (200) (not shown) will have the cord (210) connected to and made part of the envelope-like device (500) as seen in FIG. 7.

Figure 7:
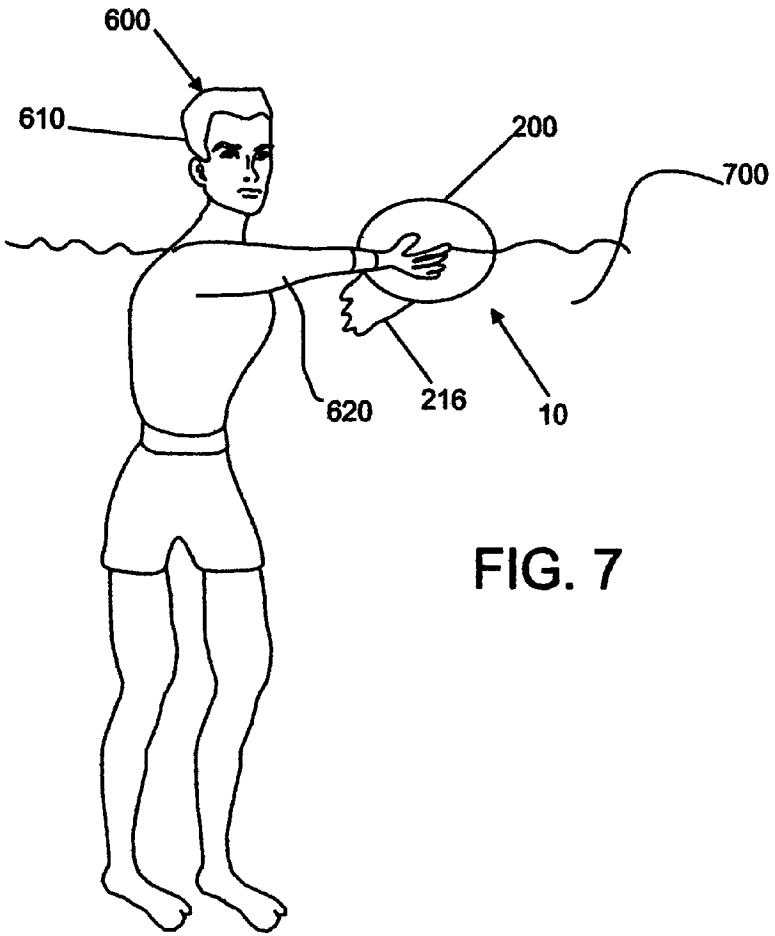
FIG. 7 shows the device in use in the water.

FIG. 7 shows the floatation device (10) in water (700). A user (600) is shown mostly submerged. The user's head (610) is above the water (700). The floatation bladder (200) is shown inflated, attached by the cord (210) at the end of the user's (600) arm (620). The floatation bladder here is shown held by the user's (600) arm (620) extended. However, in ordinary use the floatation bladder would actually be gripped under the arm (620) of a user (600) and in proximity to the user's (600) body. It would ordinarily be expected that the floatation bladder (200) would be made of either some brightly colored material, for example optic orange or optic yellow, with reflective materials such as the mirror finish on Mylar. In water with waves or that is otherwise rough, it might be difficult to see an individual and the more brightly colored or reflective the floatation bladder (200) is the easier it would be to see the user (600) while floating in the water (700). It will be readily appreciated that the user (600) could put the floatation bladder (200) entirely underwater on their chest, which would provide the greatest floatation or they could simply use their hands to hold onto the floatation bladder (200) to provide sufficient floatation to keep their head out of the water. To some degree, how the floatation bladder (200) would be used by a user (600) would depend on individual circumstances, the size of the user (600), the surface of the water (700), and other factors which cannot be readily anticipated.

It is known to one of skill in the art that there may be variations in methods and manner of construction of the device and the foregoing description is by way of illustration and not by way of limitation. The only limitations are found in the claims which follow.

The invention claimed is:

1. A wrist mounted inflatable floatation device comprising:

(a) a wrist strap adjustable for snug fit around different size wrists;

(b) detachably mounted on said wrist strap an inflatable bladder of a particular size for a comfortable fit on a user's wrist;

(c) a cord of particular length attached at a first end to said wrist strap and attached to said inflatable bladder at a second end;

(d) an inflation tube connected to said inflatable bladder by a check valve;

(e) said inflatable bladder of a particular size sized to fit when deflated in a container of less than six cubic inches in volume;

(f) said container of less than six cubic inches in volume containing said detachable inflatable bladder is detachably mounted to said wrist strap but secured to said wrist strap by said cord of a particular length;

whereby a user may detach said inflatable bladder of a particular size from said wrist strap while contained in said container of less than six cubic inches in volume and use said inflation tube to inflate said inflation bladder.

* * * * *